United States Patent [19]

Betterton et al.

[11] Patent Number: 4,967,047

[45] Date of Patent: Oct. 30, 1990

[54] SWITCH WITH POST-ASSEMBLY CALIBRATION ACCESS

[75] Inventors: Joseph T. Betterton, Arab; Thomas S. McKee, Madison; Alfred H. Glover, Decatur, all of Ala.

[73] Assignee: Acustar, Inc.

[21] Appl. No.: 294,460

[22] Filed: Jan. 9, 1989

[51] Int. Cl.[5] ..... H01H 35/34

[52] U.S. Cl. ..... 200/83 J; 73/725; 200/51 R; 200/82 R; 338/42

[58] Field of Search ..... 200/51 R, 81.4, 82 R, 200/302.1, 303, 306, 83 R, 83 S, 83 SA, 83 J; 338/36, 39, 32 H, 42, 172, 198, 200; 307/118; 340/626; 73/715, 717, 719, 723, 725, 728, 745, 746

[56] References Cited

U.S. PATENT DOCUMENTS

| | | | |
|---|---|---|---|
| 3,321,594 | 7/1965 | Reise et al. . | |
| 3,504,324 | 5/1968 | Creager . | |
| 4,255,630 | 3/1981 | Hire et al. . | |
| 4,449,112 | 5/1984 | Gould . | |
| 4,452,202 | 6/1984 | Meyer . | |
| 4,524,255 | 6/1985 | Haag . | |
| 4,581,941 | 4/1986 | Obermann et al. . | |
| 4,648,277 | 3/1987 | Obermann | 73/725 |
| 4,778,956 | 10/1988 | Betterton | 338/42 |

*Primary Examiner*—Gerald P. Tolin

[57] ABSTRACT

A fluid pressure transducer with an electrical switch structure therein including a conductor which is movable relative to fixed contacts as influenced by the force of internal spring forces whereas the relative positioning of a spring's end in the housing is adjustable after the transducer's assembly thereby effectively calibrating the switch's opening and closing characteristics relative to a predetermined fluid test pressure.

10 Claims, 5 Drawing Sheets

SWITCH WITH POST-ASSEMBLY CALIBRATION ACCESS

BACKGROUND OF THE INVENTION

Transducers for internal combustion engines are used to determine oil pressure and to produce a corresponding indicator signal. Previous transducer designs include diaphragm means, one side of which is exposed to pressurized lubricating oil. In addition to determining oil pressures, there is a need to provide a switch mechanism in the transducer to control an electric fuel pump energization. When starting an engine, the fuel pump motor should be activated only after production of a minimum oil pressure.

A number of U.S. patents disclose a pressure transducer and switch mechanism, either alone or in combination. For example, U.S. Pat. No. 3,321,594 to Reise discloses a fluid pressure actuated switch with a diaphragm sensor operatively associated with electrical contacts to control activation of an electric fuel pump motor. The U.S. Pat. No. 4,255,630 to Hire also discloses an electrical switch which is responsive to fluid pressure to control a fuel pump motor. The U.S. Pat. No. 4,524,255 to Haag discloses a switch with a movable diaphragm responsive to fluid pressure to open and close contacts of an electrical circuit.

The U.S. Pat. No. 4,581,941 to Obermann discloses a fluid pressure transducer including a switch therein adapted to control a fuel pump motor.

Several other patents have been uncovered which disclose pressure transducers without a switching device. These include U.S. Pat. Nos. 3,504,324; 4,449,112; and 4,452,202. All of the patents discussed or identified heretofore broadly disclose a pressure transducer with or without a switching mechanism but do not specifically disclose the desirable design features of the subject transducer with access means to allow calibration after final assembly of the transducer as described hereinafter.

SUMMARY OF THE INVENTION

It can be understood from the references discussed in the background that a pressure transducer which utilizes a movable diaphragm and acting in response to fluid pressure changes is known. Likewise, the inclusion of an electrical switch in such a device is also known.

The subject pressure transducer and switch assembly incorporates a desirable design which permits an accurate and simple calibration of the switch mechanism after assembly of the transducer. Specifically, the transducer has a generally hollow housing which encloses a movable diaphragm and piston assembly responsive to fluid pressure changes. The piston assembly is engaged by one end of a two spring combination which are stacked to bias the piston against the forces of fluid pressures on the diaphragm. The opposite end of the spring combination is axially secured by a grip fastener member which is adjustably retained in the housing by frictional engagement of its peripheral edge with the interior surface of the housing. Axial movements of the grip fastener toward the spring decreases the length of the spring combination and thus the response characteristics of the transducer.

The transducer's switch mechanism includes fixed contacts adjacent the interior surface of an end cover member. A movable switch contact assembly is supported between the springs. Resultantly, the contact assembly moves relative to the fixed contacts as the length of the spring combination changes. The end cover member has access openings extending therethrough which are axially aligned with the spring's grip fastener. The access openings allow the insertion of elongated calibration setting members after assembly of the transducer which axially adjust the grip fastener position to produce a desired switch function.

Therefore, an object of the invention is to provide a simple, inexpensive yet reliable fluid pressure responsive transducer with switch capabilities and operative switch parts which are readily calibrated after final assembly of the transducer.

A further object of the invention is to provide an improved fluid pressure responsive transducer which incorporates a switch assembly with a movable contact and a switch spring adjustable by externally applied calibration means.

A still further object of the invention is to provide an improved fluid pressure responsive transducer and switch assembly with a movable contact which is supported between a pair of coil springs stacked end to end, one end of the spring combination being retained in the transducer housing by a frictional fit between a spring fastener member and the transducer housing so that the fastener's axial position can be slidably adjusted by calibration members which have access to the transducer interior through small openings.

Further advantageous features and objects of this transducer and switch will be more readily apparent from a reading of the following detailed description of an embodiment, reference being made to drawings of a preferred embodiment.

IN THE DRAWINGS

FIG. 1 is an elevational view of the subject pressure transducer and switch device; and FIG. 2 is an enlarged planer view of the transducer and switch device looking in the direction of arrow 2 shown in FIG. 1; and FIG. 3 is a sectioned view of the assembly taken along section line 3—3 in FIG. 2 and looking in the direction of the arrows; and FIG. 4 is a sectioned view of the device taken along section line 4—4 in FIG. 2 and looking in the direction of the arrows; and FIG. 5 is a sectioned view of the device taken along section line 5—5 in FIG. 4 and looking in the direction of the arrows; and FIG. 6 is a sectioned view of the device taken along section lines 6—6 in FIG. 4 and looking in the direction of the arrows; and FIG. 7 is a sectioned view of the device taken along section line 7—7 in FIG. 4 and looking in the direction of the arrows; and FIG. 8 is a sectioned view of the device taken along section line 8—8 in FIG. 4 and looking in the direction of the arrows.

DESCRIPTION OF A PREFERRED EMBODIMENT

Figure 1:
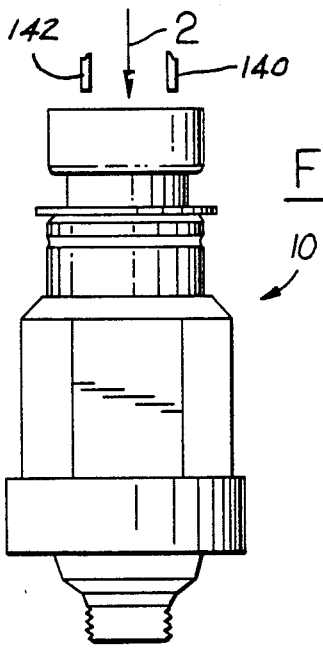
Figure 3:
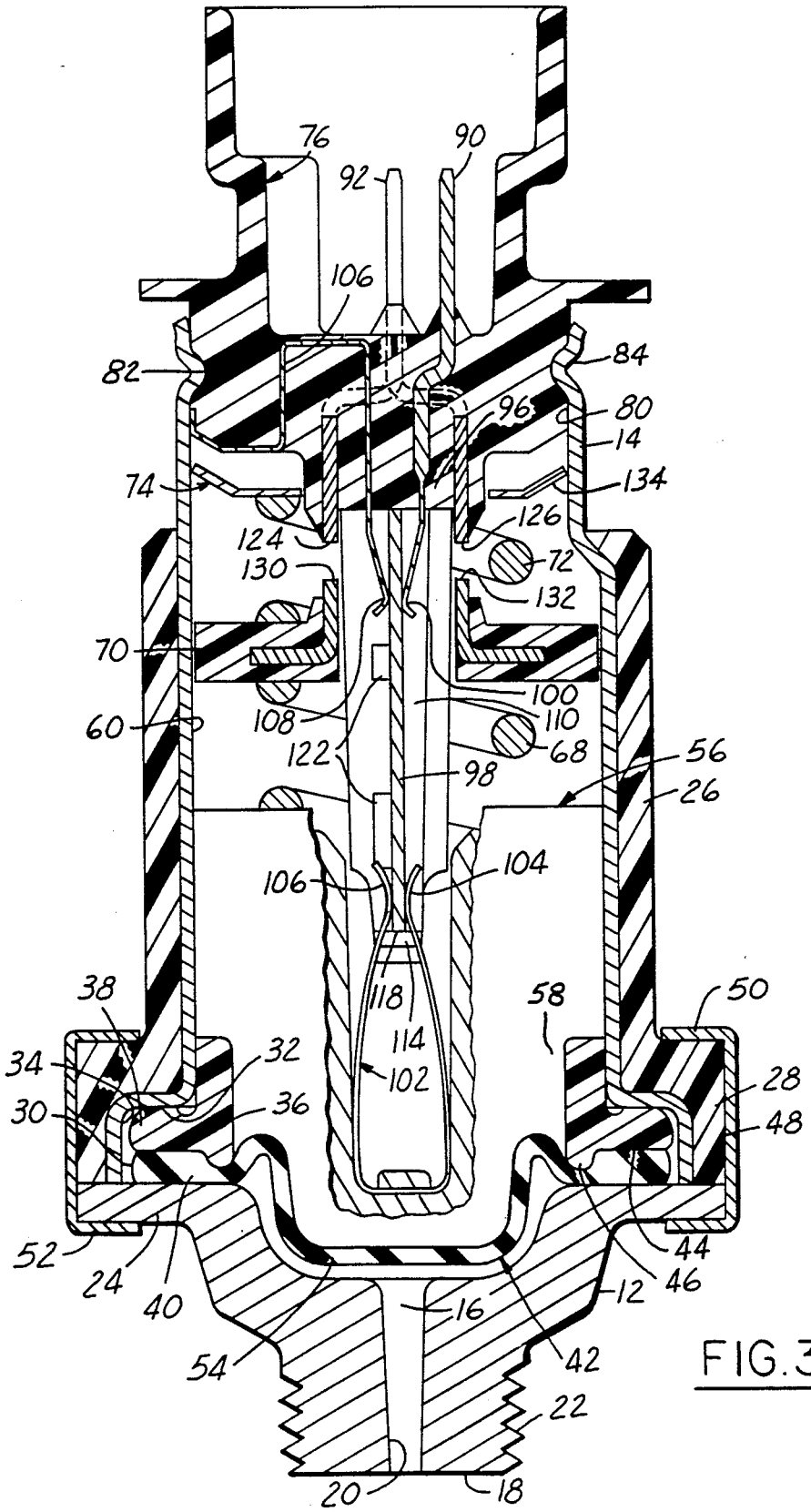
Figure 4:
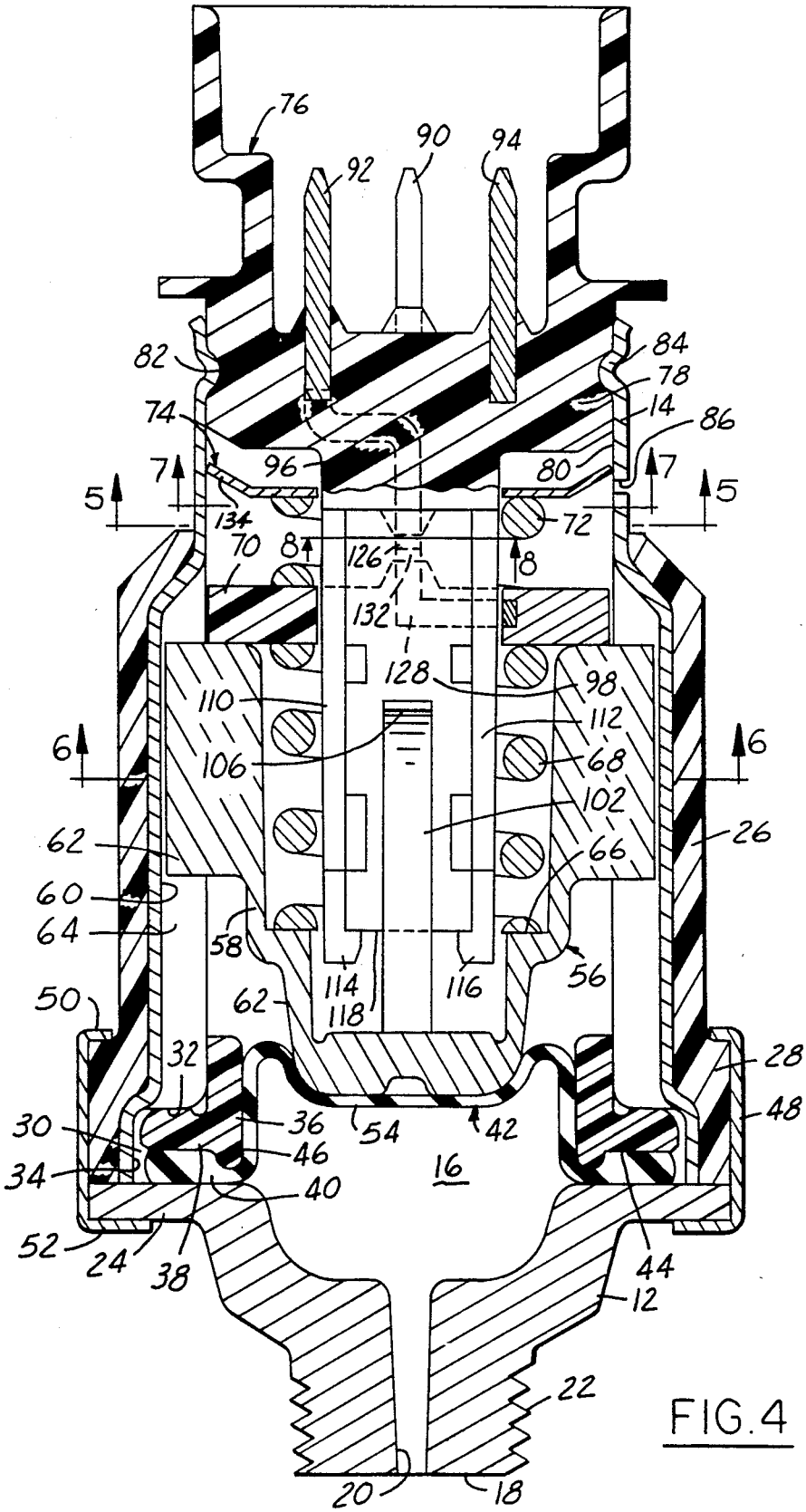

In FIG. 1, the subject transducer and switch device 10 is illustrated. Device 10 includes enclosure means primarily formed by two housing portions 12 and 14 as best illustrated in FIGS. 3 and 4. Specifically, housing portion 12 has a generally cup shaped configuration and defines a hollow interior 16. It has a lower end portion 18 with a central aperture or opening 20 therethrough. Further, housing 12 has a threaded cylindrical exterior portion 22 which is adapted to connect the device 10 to a similarly threaded aperture of a vehicle engine. Specifically the threaded portion 22 communicates the device's central opening 20 with a pressurized oil lubrication passage of the vehicle engine. Resultantly, pressurized lubrication oil is admitted into the interior space 16. The upper end of housing 12 includes a radially outwardly extending flange portion 24 for engagement with the lower end portion of the other main housing member 14.

Figure 5:
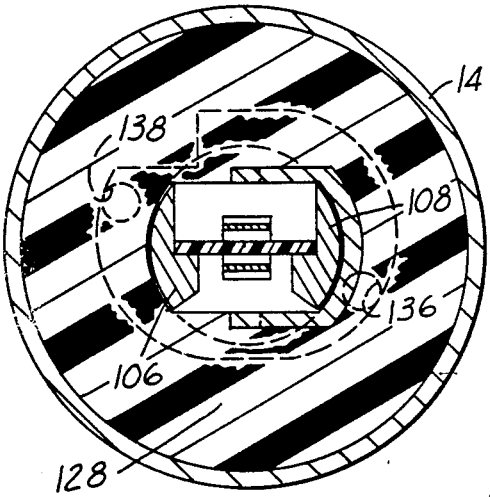
Figure 6:
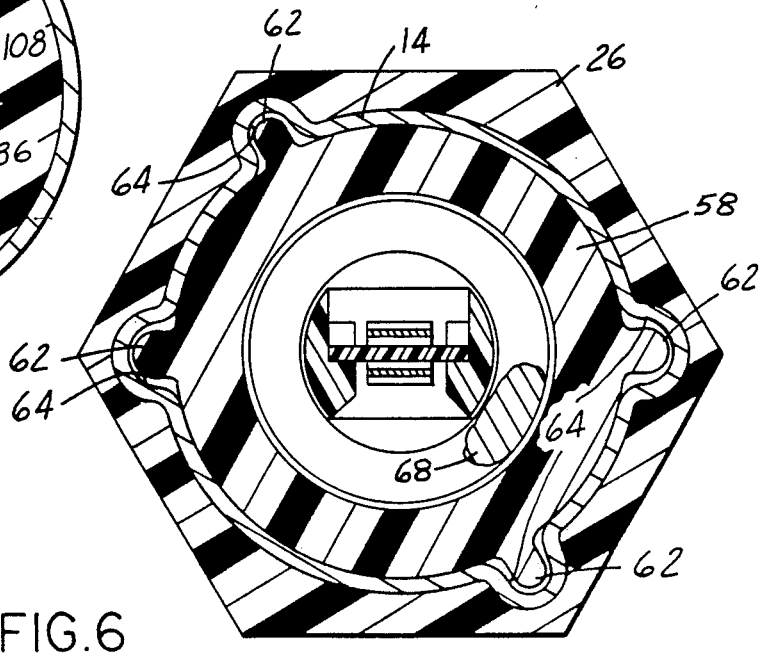

The other main housing member 14 has a substantially tubular configuration as is evident from FIGS. 3, 4, 5 and 6. The mid portion and lower half of the outer surface of housing member 14 is covered by a molded elastomeric member 26. The member 26 has a hexagonal cross sectional configuration as shown in FIG. 6. Resultantly, a tool may be applied to the flats of the hexagonal configuration to rotate the transducer as it is connected to the engine. The lower end portion of housing member 14 extends radially outwardly and so does the lower portion of member 26 thus forming outward flange portion 28. Flange 28 is adapted to engage the flange 24 of lower housing member 12 to attach the housings together.

The flange portions 24 and 28 define an annularly shaped recess 30 therebetween having a shoulder forming surface 32 and an outer side surface 34. The recess 30 receives an annularly shaped member 36 and more specifically an outer portion 38 thereof. The portion 38 of member 36 engages an outer peripheral edge 40 of a flexible diaphragm member 42. As shown, the peripheral edge 40 of diaphragm 42 is thickened and is mounted within a grove or channel 44 partially formed by an annularly shaped depending edge 46. The member 36, edge 40 and flange 24 are held together and against shoulder 32 by an encircling retainer 48. The retainer 48 has edge portions 50 and 52 which are folded over flanges 28 and 24 respectively to secure the retainer to the device.

The diaphragm 42 includes a flexible mid portion 54 which is exposed to pressurized oil in space 16 on one side. The other side of the diaphragm 42 is operatively attached to a piston member 56. Member 56 has a cup shaped configuration with a substantially cylindrical main body portion 58 and is adapted to reciprocate within a similarly configured surface 60 of housing 14. Thus, the diaphragm mid portion 54 and the attached piston 56 are supported in housing 14 for reciprocation in the axial direction or up and down in FIGS. 3 and 4. Obviously, the position of the piston 56 in FIG. 3 corresponds to a zero or relatively low oil pressure in interior 16. Likewise, the position of piston 56 in FIG. 4 corresponds to a relatively high oil pressure in interior 16.

As best shown in FIG. 6, the piston member 56 is limited to reciprocative movement and restrained from rotative movement in housing 14 by means of four outwardly projecting ribs 62 which loosely fit into channels 64 formed in the wall of housing member 14.

Referring back to FIG. 4, the interior of the cup shaped piston member 56 is more voluminous at the upper end and less so at the lower end. Between the two spaces, an angularly extending shoulder 66 extends. Shoulder 66 supports the lower end of a coil type piston spring 68. The upper end of the coil spring 68 engages the lower surface of a bridge member 70 which is perhaps best shown in FIG. 5. The upper surface of the bridge member 70 is engaged by a second spring 72 whose upper end is axially retained or supported by a fastener member 74 best shown in FIG. 7. The combination of the two springs 68 and 70 bias the piston member 56 downward toward the position shown in FIG. 3. When oil pressure increases, the springs are compressed and the piston moves upward toward the position in FIG. 4.

The above described coil springs 68 and 72 obviously have quite different heights and may also have different spring rates. As a consequence of the series or end to end relationship of the two springs, upward movements of piston 56 causes the bridge member located between the two springs to move upward. The function of the bridge member is for fuel pump control will be explained in more detail hereinafter. However, prior to that explanation, an explanation of the related oil pressure indicating apparatus is provided in the following paragraphs.

Other than controlling the electric fuel pump, another function of the transducer 10 is to determine oil pressure and produce an appropriate transducer condition corresponding to the oil pressure level. The subject transducer produces an electrical resistance which is appropriate for each level of oil pressure. In order for this resistance to be of use, it must be a part of a circuit so that the change in resistance can then be interpreted and changes indicated as pressure data.

Figure 2:
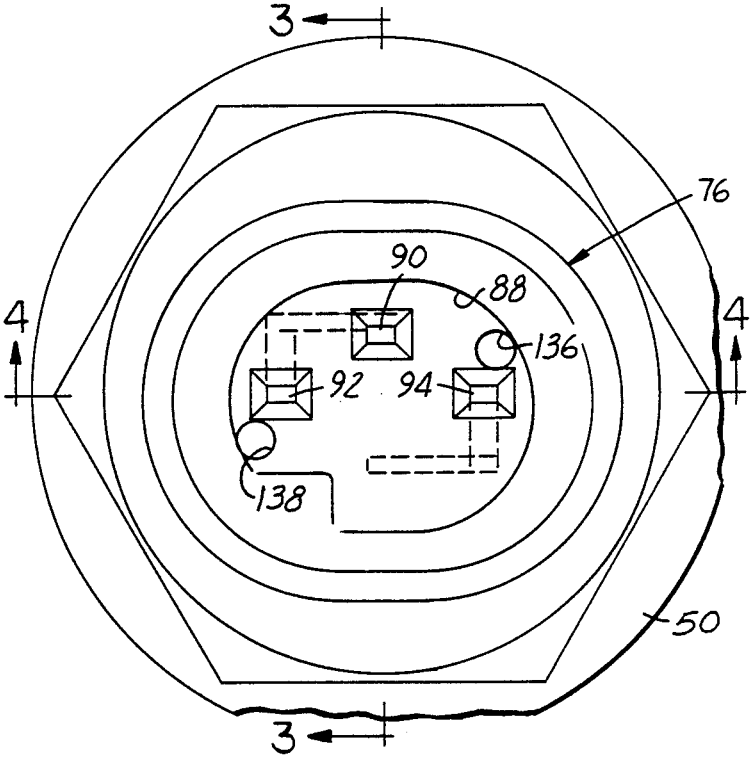

An end cover member 76 is positioned at the upper end of housing 14 for the purpose of closing the transducer interior. In addition to closing the transducer interior, the end member 76 also functions as a support for electrical terminals or connectors. With reference to FIGS. 2, 3 and 4, the end member 76 has a substantially cylindrical base portion 78 which is inserted into the substantially cylindrical end or recess 80 of housing 14. The base 78 also includes a groove or channel 82 into which an inward crimp 84 of member 14 is extended. This secures members 14 and 76 together.

Movement of the diaphragm and piston in the housing interior obviously creates a variable volume condition. To prevent trapped air from generating pressures which might have an undesirable influence on the transducer operation, a small air bleed hole 86 is provided through the upper wall of housing 14 as shown in FIG. 4.

The end member 76 forms an open ended recess 88 for receiving an electrical connector plug (not shown). The connector is for transmitting outputs from the transducer and the switch assembly. Three terminals 90, 92 and 94 extend away from the bottom of recess 88. The terminals are integral with conductors which extend through the end member 76. The terminals and the conductors 90, 92 and 94 extend downward through a central portion 96 of member 76.

One terminal and conductor 90 is for determining engine oil pressure as in the interior 16. Central portion 96 provides support for an elongated and flat resistor card or board 98 which extends downward from the end member 76 in an axial direction through the interior of housing 14. The resistor card or board 98 has elongated conductor and resistance grids (not shown) on the surfaces of the board and extending in the axial direction. As best shown in FIG. 3, the terminal and conductor 90 extends through end member 76 and has an end portion 100 formed to resiliently press against the surface of the board 98 and thus be connected with one end of the resistance grid. A generally U-shaped metal member 102 is attached to the piston member 58 and has curved end portions 104 and 106 which engage opposite sides of the card or board 98. The function of the member 102 is to connect the resistance grid on one side of the board with a conductor on the other side of the board. Also, as the piston reciprocates in the housing 14, the member 102 is slid over and along the resistance grid. This changes the resistance characteristic of the circuit corresponding to oil pressure levels. The other end of the resistance grid and conductor of the board 98 is connected to ground by a conductor 106 which also extends through the end member 76. Specifically, the conductor 106 has an end portion 108 which resiliently presses against the surface of the board 98 and a conductive strip thereon. The other end of the conductor 106 engages the inner surface of the housing 14 which in turn is electrically connected to the housing 12 which is connected to the engine.

Figure 8:
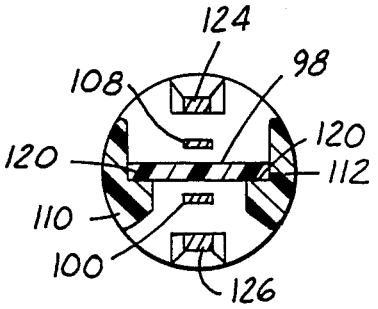

As previously stated, the card or board 98 is supported by end member 76. As shown in FIG. 4, left and right side supports 110 and 112 are integrally connected to and depend from the central portion 96. The side supports have lower end portions 114 and 116 which engage the bottom edge 118 of the resistor card or board 98. Also as shown in FIG. 8, the side supports 110 and 112 form shoulders 120 against which the board 98 rests. As shown in FIG. 3, a number of tabs 122 engage the opposite side of the board than the shoulders to secure the board.

As previously mentioned, a function of the transducer is for controlling the electric fuel pump motor corresponding to oil pressure. The terminals 92 and 94 of end member 76 are for this purpose. Terminals 92 and 94 integrally include conductor portions extending through the end member 76 as seen in FIG. 3. The conductors terminate just below the lower surface of the central portion 96 to form a pair of spaced contacts 124 and 126. Previously, the terminal bridge member 70 was introduced. It is a generally annularly shaped member supported between the lower and upper springs 68 and 72. Bridge member 70 is molded of elastomeric material and substantially encloses a metal conductor 128 so that the bridge 70 moves as one. The conductor 128 has a pair of upstanding extensions forming spaced contacts 130 and 132 as best shown in FIG. 3. The contacts 130, 132 of the conductor 128 are positioned to be axially in line with contacts 124 and 126, respectively, of the end member 76. When increased oil pressure causes the piston to be moved upward, the contact pairs 124, 130 and 126, 132 are engaged to complete a circuit through the conductor 128 and between the terminals 92, 94. Thus, the fuel pump motor is energized by completing the associated circuit connected to the terminals 92, 94.

The previously described fuel pump switch construction with two serial springs and movable bridge therebetween allows a closing function of the switch corresponding to an increase in oil pressure. The subject transducer also includes structure for convenient calibration of the switch externally of the transducer after it is finally assembled. Specifically, the upper of the serial springs 68, 72 which support the bridge member 70, is supported by a retainer member 74 best shown in FIG. 7. The member 74 has an apertured center for fitting about the central portion 96 of the end member 76. The edge portion is formed into a plurality of fingers 134 which are bent upward from the plane of the central portion as shown in FIGS. 3, 4. Also, the housing 14 and a portion of the member 74 including fingers 134 are decreased in diameter dimension as in FIG. 7 so that the member cannot rotate in the housing. The member 74 is preferably made of spring steel so that the fingers 134 resiliently bear against the inner wall of the housing 14. This produces a tight frictional relationship between the fingers 134 and the housing 14 strongly resisting upward movement of the fastener member 74 from the position shown in FIGS. 3, 4. In this manner the springs 68, 72 are retained in the transducer.

Figure 7:
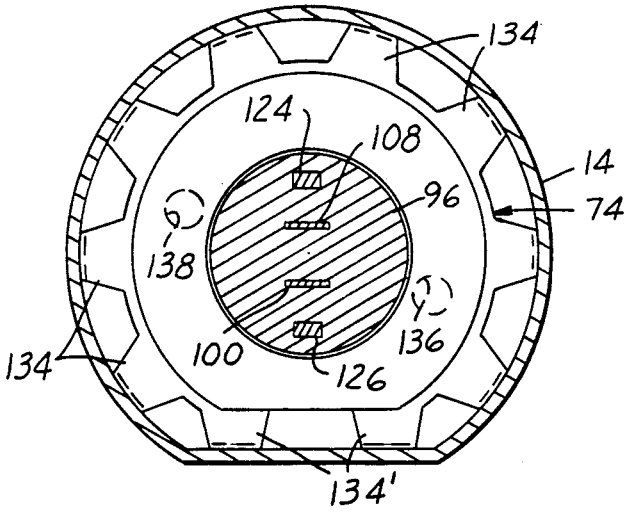

Obviously, it would be desirable to calibrate the transducer by setting the axial position of the fastener retainer 74 after final assembly. To do this, the fastener 74 is initially positioned high in the interior of the housing 14 (upward from the positions shown in FIGS. 3, 4). This high setting causes the springs to engage the contact pairs 124, 130 and 126, 132 in the assembled transducer prior to calibration. Next, the interior 16 of the transducer is exposed to a predetermined oil pressure. A pair of apertures 136, 138 are provided in the end member 76 as shown in FIGS. 2, 5 and 7. A pair of calibration members 140, 142 are then moved downward through the apertures 136, 138 until they contact the upper surface of the fastener 74. Further downward movement of the members 140, 142 cause the grip fastener to slide along the housing wall until the contacts separate. It may also be desirable to set a further gap between the contact pairs. The upward orientation of the fastener's fingers 134 and the resilient force of the fingers against the housing hold the fastener in the set calibrated position against the force of the springs.

Although the preceding detailed description of the transducer and its operation is specific to only one embodiment, the invention is not necessarily limited to the total combination except as described by the claims. It also should be understood that the specific device is subject to modifications which may not fall outside the scope of the following claims which define the invention.

I claim:

1. A switch structure in a fluid pressure transducer which permits calibration of the switch after assembly of the transducer whereby switch characteristics are set externally as the transducer is exposed to a test pressure, comprising: a hollow enclosure means with an apertured end adapted to be communicated with a fluid pressure system such as the lubrication system of a vehicle engine; diaphragm means with a peripheral edge attached to the enclosure means and with a flexible mid portion extending across the enclosure interior thereby separating the interior into first and second chambers, the first chamber communicated with the apertured end to receive pressurized fluid, the second chamber communicated with atmospheric pressure whereby a pressure force produced against the diaphragm means tends to move the diaphragm; a piston member supported in the second chamber for reciprocal motion in an axial direction toward and away from the enclosure's apertured end, the piston being operatively attached to the mid portion of the diaphragm means for movement therewith; an end cover member of the enclosure closing the enclosure end opposite the apertured end; insulated electrical conductor means extending through the end cover member and forming contact means in the second chamber; a first compression type coil spring engaging the piston at one end and extending toward the end cover member; a bridge member engaging the other end of the first spring on one end surface; a second compression type coil spring with one end engaging the opposite end surface of the bridge member and extending toward the end cover member; a fastener member with a peripheral edge frictionally engaging the enclosure means in a manner permitting sliding movement thereof away from the end cover member; the bridge member carrying an electrical conductor movable therewith to engage the contact means and complete a circuit from the conductor means whereby increased pressure in the first chamber causes the piston to compress the springs and move the conductor of the bridge member into contact with the contact means; opening means through the end cover member and axially aligned with the spring fastener so that externally operated elongated calibration means can be extended therethrough to move the spring fastener axially away from the end member to cause the bridge member and its conductor to move away from the contact means as the transducer is exposed to a test pressure.

2. In a fluid pressure transducer having an electrical switch for controlling energization of an external circuit, improved switch structure for permitting switch calibration of opening and closing characteristics after the final assembly of the transducer by externally controlled calibrators while the transducer is exposed to a test pressure, comprising: a substantially hollow housing enclosing an interior, the enclosure housing having an apertured end adapted to receive pressurized fluid into the interior; diaphragm means having a peripheral edge and a flexible mid portion, the peripheral edge being attached to the housing with the mid portion extending across the interior of the enclosure to separate it into first and second chambers, the first chamber being communicated with the apertured end to receive pressurized fluid and the second chamber communicated with atmospheric pressure whereby a net pressure force is produced on the diaphragm tending to move it toward and away from the apertured end; a piston in the second chamber and operatively attached to the mid portion of the diaphragm, the piston being supported for reciprocation permitting it to move axially towards and away from the apertured end; an end cover member of the housing closing the end which is opposite the apertured end; a pair of electrically conductive terminals which extend through the end cover member and terminate in the housing interior producing exposed contacts located above the piston; a bridge member having opposite end surfaces and being located between the piston and the contacts, the bridge member carrying a conductor which has portions axially aligned with the exposed contacts so that reciprocation of the bridge member toward the end cover member engages the conductor with the exposed contacts thereby connecting the associated pair of terminals; a first compression type coil spring extending between the piston and an end surface of the bridge member; a second compression type coil spring with an end seated against an opposite end surface of the bridge member; a spring grip fastener supporting the other end of the second spring adjacent the end cover member; peripheral edge means of the grip fastener which frictionally engage the encircling housing to resist axial movements and elongation of the two springs but permit opposite axial movement in response to an application of a significant calibration force on the grip fastener in a direction away from the end cover member whereby a balance of pressure and spring forces on the diaphragm and piston positions the bridge member and its conductor portions relative to the exposed contacts of the end cover member; opening means extending through the end cover member which is aligned with the bridge member so that the bridge member can be moved away from the end cover member by externally applied calibration forces applied through the opening means whereby the spring grip fastener is moved away from the end cover member thereby adjusting the position of the bridge member and its conductor relative to the exposed contacts while at the same time the apertured end of the transducer is exposed to a fluid test pressure.

3. The switch structure of claim 2 in which the opening means for calibration access extends in the axial direction of the housing and further includes a spaced pair of diametrically positioned apertures aligned with the central portion of the grip fastener.

4. The switch structure of claim 3 in which the end cover member defines an externally located recess adapted to receive a circuit connector; the pair of access openings in the end cover member being positioned in the recess so they are normally covered when the transducer is in use with an engine.

5. The switch structure in claim 2 in which the grip fastener has a substantially flat central portion which is adapted to be engaged during calibration; the peripheral edge means of the grip fastener being distorted away from the plane of the central portion and in a general direction toward the end cover member so that the grip fastener strongly resists movement toward the end cover member but sell strongly resists opposite movement away from the end cover member.

6. The switch structure of claim 5 in which the peripheral edge of the grip fastener is configured with a plurality of separate fingers which are spaced about its circumference.

7. The switch structure of Claim 6 in which the grip fastener is formed of hardened metal and the fingers have sharp edges which tend to strongly resist movement of the grip fastener upward toward the end cover member.

8. The switch structure of claim 2 in which the length of the first spring is significantly longer then the length of the second spring.

9. The switch structure of claim 2 in which the bridge member is of molded electrically insulative material and partially encloses the conductor so that both move axially in the housing as a unitary structure.

10. The switch structure of claim 2 in which the means are provided to inhibit rotation of the piston so that the connected springs and bridge member also will not rotate in the housing.

* * * * *